US009864308B2

(12) United States Patent
Taira

(10) Patent No.: US 9,864,308 B2
(45) Date of Patent: Jan. 9, 2018

(54) IMAGE FORMING APPARATUS FOR APPLYING A VOLTAGE TO A UNIT FOR TRANSPORTING A RECORDING MEDIUM

(71) Applicant: FUJI XEROX CO., LTD., Tokyo (JP)

(72) Inventor: Seiji Taira, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/247,136

(22) Filed: Aug. 25, 2016

(65) Prior Publication Data

US 2017/0192376 A1 Jul. 6, 2017

(30) Foreign Application Priority Data

Jan. 4, 2016 (JP) ..... 2016-000102

(51) Int. Cl.
*G03G 15/20* (2006.01)
*G03G 15/16* (2006.01)

(52) U.S. Cl.
CPC ..... *G03G 15/1665* (2013.01)

(58) Field of Classification Search
USPC ..... 399/38, 44, 45, 66, 297, 314, 316
See application file for complete search history.

(56) References Cited

U.S. PATENT DOCUMENTS 8,855,544 B2 * 10/2014 Namisaki ..... G03G 15/2028 399/397
9,280,099 B2 * 3/2016 Makino ..... G03G 15/1675
2008/0013993 A1 1/2008 Obata et al.

FOREIGN PATENT DOCUMENTS

JP 2008-020739 A 1/2008
JP 2013-238896 A 11/2013

* cited by examiner

*Primary Examiner* — Hoan Tran
(74) *Attorney, Agent, or Firm* — Oliff PLC

(57) ABSTRACT

There is provided an image forming apparatus. A transferring unit transports a recording medium while transferring an image onto the recording medium by a transfer voltage being applied thereto. A fixing member fixes the transferred image onto the recording medium. A conductive member forms a nip portion in which the recording medium is nipped between the fixing member and the conductive member and has a conductive property. A guiding unit is disposed between the transferring unit and the nip portion, guides a leading end of the recording medium which is being transported by the transferring unit to the nip portion, and has a conductive property. An applying unit applies, to the transferring unit, a transfer voltage which is higher than that applied before the recording medium is put into the nip portion, after the recording medium transported by the transferring unit is put into the nip portion.

3 Claims, 6 Drawing Sheets

IMAGE FORMING APPARATUS FOR APPLYING A VOLTAGE TO A UNIT FOR TRANSPORTING A RECORDING MEDIUM

CROSS-REFERENCE TO RELATED APPLICATIONS

This application is based on and claims priority under 35 USC 119 from Japanese Patent Application No. 2016-000102 filed Jan. 4, 2016.

TECHNICAL FIELD

The present invention relates to an image forming apparatus.

SUMMARY

According to an aspect of the invention, an image forming apparatus includes a transferring unit that transports a recording medium while transferring an image onto the recording medium by a transfer voltage being applied thereto, a fixing member that fixes the transferred image onto the recording medium, a conductive member that forms a nip portion in which the recording medium is nipped between the fixing member and the conductive member and that has a conductive property, a guiding unit that is disposed between the transferring unit and the nip portion, that guides a leading end of the recording medium which is being transported by the transferring unit to the nip portion, and that has a conductive property, and an applying unit that applies, to the transferring unit, a transfer voltage which is higher than that applied before the recording medium is put into the nip portion, after the recording medium transported by the transferring unit is put into the nip portion.

BRIEF DESCRIPTION OF THE DRAWINGS

Exemplary embodiments of the present invention will be described in detailed based on the following figures, wherein.

DETAILED DESCRIPTION

Hereinafter, an example of an exemplary embodiment according to the invention will be described based on the drawings.

Image Forming Apparatus 10

Figure 1:
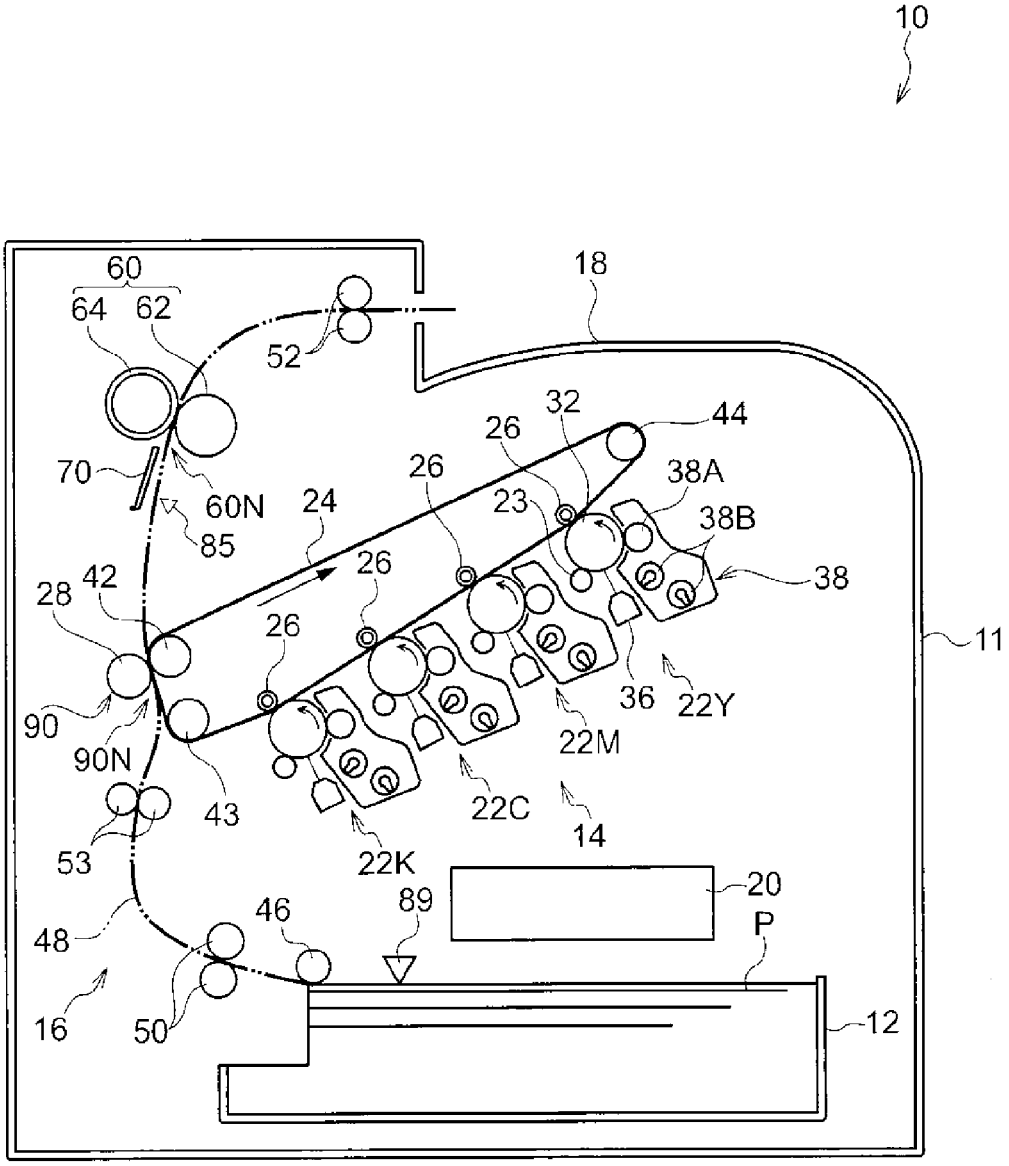
FIG. 1 is a schematic diagram illustrating a configuration of an image forming apparatus according to the exemplary embodiment.

First of all, a configuration of an image forming apparatus 10 will be described. FIG. 1 is a schematic diagram illustrating a configuration of the image forming apparatus 10.

The image forming apparatus 10 includes an image forming apparatus main body 11 (housing) in which each component of the image forming apparatus 10 is housed as illustrated in FIG. 1. An accommodating portion 12, an image forming portion 14, and a fixing device 60 are provided in the image forming apparatus main body 11. The accommodating portion 12 accommodates a recording medium P such as paper. The image forming portion 14 forms an image onto the recording medium P. The fixing device 60 fixes the image, which is formed on the recording medium P, onto the recording medium P. In addition, a transporting unit 16 that transports the recording medium P from the accommodating portion 12 to the image forming portion 14, and a controller 20 that controls an operation of each unit of the image forming apparatus 10 are provided in the image forming apparatus main body 11. An output unit 18 that outputs the recording medium P on which the image is fixed by the fixing device 60 is provided in an upper part of the image forming apparatus main body 11.

The image forming portion 14 includes image forming units 22Y, 22M, 22C, and 22K (hereinafter, referred to as image forming units 22Y to 22K) that form toner images with toner of respective colors, such as yellow (Y), magenta (M), cyan (C), and black (B), and an intermediate transfer belt 24 (transferring member) on which the toner images formed by the image forming units 22Y to 22K are transferred. The image forming portion 14 further includes primary transfer rolls 26 and a secondary transfer roll 28. The primary transfer rolls 26 transfer the toner images formed by the image forming units 22Y to 22K to the intermediate transfer belt 24. The secondary transfer roll 28 that transfers the toner images, which are transferred to the intermediate transfer belt 24 by the primary transfer rolls 26, from the intermediate transfer belt 24 onto the recording medium P. The image forming portion 14 is not limited to the above configuration. The image forming portion 14 may have any configuration so long as an the image forming portion 14 forms an image onto a recording medium P.

The image forming units 22Y to 22K are disposed in a state of being tilted with respect to a horizontal direction in the image forming apparatus main body 11. Each of the image forming units 22Y to 22K has a photoconductor 32 that rotates in one direction (for example, a counterclockwise direction in FIG. 1). Since each of the image forming units 22Y to 22K has the same configuration, a reference numeral of each part of the image forming units 22M, 22C, and 22K is omitted in FIG. 1.

In the vicinity of each of the photoconductors 32, a charging roll 23, an exposure device 36, and a developing device 38 are provided in the order from an upstream side in a rotation direction of the photoconductor 32. The charging roll 23 serves as a charging device and charges the photoconductor 32. The exposure device 36 exposes the photoconductor 32 charged by the charging roll 23 to form an electrostatic latent image on the photoconductor 32. The developing device 38 develops the electrostatic latent image, which is formed on the photoconductor 32 by the exposure device 36, to form the toner image.

The exposure device 36 forms the electrostatic latent image based on an image signal transmitted from the controller 20. An example of the image signal transmitted from the controller 20 includes an image signal acquired by the controller 20 from an external device.

The developing device 38 includes a developer supplying member 38A that supplies a developer to the photoconductor 32, and plural transporting members 38B that agitate and transport the developer to the developer supplying member 38A.

The intermediate transfer belt 24 is formed in a ring-shape, and is disposed on the image forming units 22Y to 22K. Winding rolls 42, 43, and 44 around which the intermediate transfer belt 24 is wound are provided on the inner periphery of the intermediate transfer belt 24. For example, by the winding roll 44 being rotation-driven, the intermediate transfer belt 24 goes around (rotates) in one direction (for example, clockwise in FIG. 1) while maintaining contact with the photoconductors 32. The winding roll 42 is a facing roll of the secondary transfer roll 28.

The primary transfer roll 26 faces the photoconductor 32 with the intermediate transfer belt 24 being placed therebetween. A point between the primary transfer roll 26 and the photoconductor 32 is a primary transfer position at which the toner image formed on the photoconductor 32 is transferred to the intermediate transfer belt 24.

A primary transfer voltage (primary transfer current) having an opposite polarity to a polarity of the toner is applied to the primary transfer rolls 26. Accordingly, a primary transfer electric field is formed between the photoconductor 32 and the primary transfer roll 26. As a result, electrostatic force is exerted on the toner image formed on the photoconductor 32, and the toner image is transferred from the primary transfer position to the intermediate transfer belt 24.

The secondary transfer roll 28 faces the winding roll 42 with the intermediate transfer belt 24 being placed therebetween. A point between the secondary transfer roll 28 and the winding roll 42 is a secondary transfer position at which the toner image transferred on the intermediate transfer belt 24 is transferred onto the recording medium P.

A transfer nip 90N (nip portion) in which the recording medium P is nipped is formed between the secondary transfer roll 28 and the intermediate transfer belt 24 (winding roll 42). The secondary transfer roll 28 rotates, for example, in accordance with the movement of the intermediate transfer belt 24 that goes around. The secondary transfer roll 28 rotates with the recording medium P, which is put into the transfer nip 90N, being nipped between the secondary transfer roll 28 and the intermediate transfer belt 24 (the winding roll 42), to thereby transport the recording medium P.

The secondary transfer roll 28 may be configured to be rotation-driven or may be configured to rotate.

Figure 2:
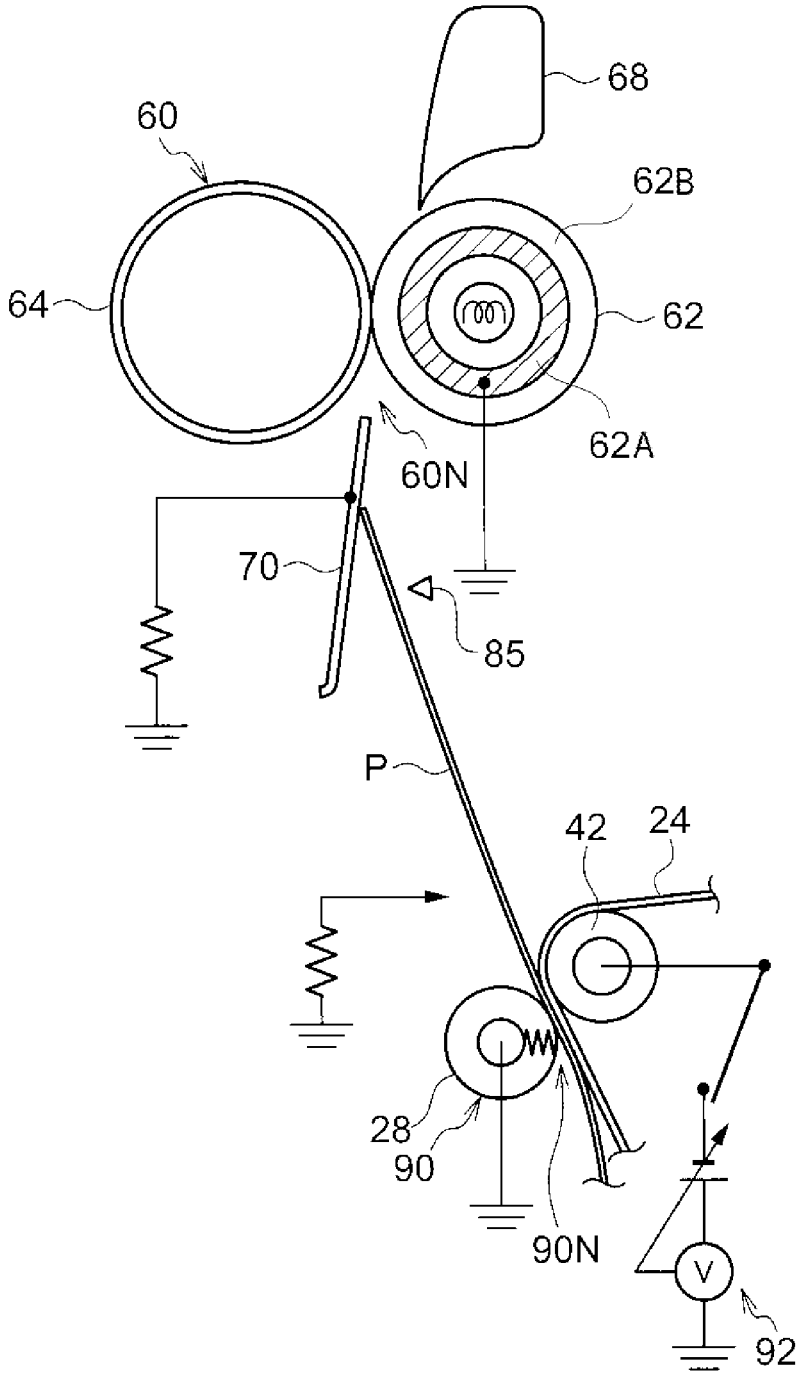
FIG. 2 is an enlarged schematic diagram illustrating a partial configuration of the image forming apparatus according to the exemplary embodiment.

As illustrated in FIG. 2, a secondary transfer voltage (secondary transfer current) having the same polarity as the toner is applied to the winding roll 42 by a power supplying unit 92 (an example of an applying unit). Accordingly, a secondary transfer electric field is formed between the winding roll 42 and the secondary transfer roll 28. As a result, electrostatic force is exerted on the toner image on the intermediate transfer belt 24, and the toner image is transferred onto the recording medium P at the secondary transfer position.

As described above, the secondary transfer roll 28, the winding roll 42, and the intermediate transfer belt 24 constitute a transferring unit 90 (an example of a transferring unit) that transports the recording medium P while transferring the toner image onto the recording medium P.

As illustrated in FIG. 1, the transporting unit 16 has a sending roll 46, a transporting path 48, transporting rolls 50, and transporting rolls 53. The sending roll 46 sends out the recording medium P accommodated in the accommodating portion 12. The recording medium P sent out by the sending roll 46 is transported to the transporting path 48. The transporting rolls 50 transport the recording medium P sent out by the sending roll 46 to a downstream side. The transporting rolls 53 transport the recording medium P transported by the transporting rolls 50 to the secondary transfer position.

The fixing device 60 is disposed on the downstream side in a transporting direction with respect to the secondary transfer position. The fixing device 60 forms a fixing nip 60N (an example of the nip portion) in which the recording medium P is nipped between a fixing roll 62 (an example of a fixing member) and a pressure belt 64 (an example of a conductive member).

The pressure belt 64 is configured with a metal belt, and has a conductive property. The pressure belt 64 has a higher conductive property than at least the fixing roll 62. Heating by the fixing roll 62 and pressurizing by the pressure belt 64 in the fixing device 60 fix the toner image, which is transferred from the intermediate transfer belt 24 to the recording medium P, onto the recording medium P.

The fixing roll 62 is configured such that the outer circumference of a metal roll 62A is coated with a resin layer 62B as illustrated in FIG. 2. The metal roll 62A is grounded. A separation pawl 68 (separating unit) that separates the recording medium P attached to the fixing roll 62 is provided on the downstream side in the transporting direction with respect to the fixing nip 60N.

Hereinafter, image forming operations to form an image onto the recording medium P in the image forming apparatus 10 according to the exemplary embodiment will be described.

In the image forming apparatus 10 according to the exemplary embodiment, the recording medium P sent out from the accommodating portion 12 by the sending roll 46 is sent to the secondary transfer position by the transporting rolls 53 (refer to FIG. 1).

In the image forming units 22Y to 22K, the exposure device 36 exposes the photoconductor 32 charged by the charging roll 23 to form the electrostatic latent image onto the photoconductor 32. The developing device 38 develops the electrostatic latent image to form the toner image onto the photoconductor 32. Once the toner image of each color formed in the image forming units 22Y to 22K is transferred to the intermediate transfer belt 24 from the primary transfer position, a color image is formed. Then, the color image formed on the intermediate transfer belt 24 is transferred onto the recording medium P at the secondary transfer position.

The recording medium P on which the toner image is transferred is transported to the fixing device 60, and the transferred toner image is fixed by the fixing device 60. The transporting rolls 52 output the recording medium P on which the toner image is fixed to the output unit 18. In such a manner, a series of image forming operations are conducted.

(Configurations of Main Portions)

In the exemplary embodiment, a chute 70 (an example of a guiding unit) that guides a leading end of the recording medium P, which is being transported by the secondary transfer roll 28 and the intermediate transfer belt 24 which configure the transferring unit 90, to the fixing nip 60N is disposed between the fixing nip 60N (fixing device 60) and the transfer nip 90N (transferring unit 90).

The chute 70 is made of, for example, a metal, and has a conductive property. If the chute 70 is made of resin, the toner on the toner image may be affected by triboelectric charging caused by friction between the recording medium P and the chute 70. Therefore, the chute 70 made of metal is used. In addition, the chute 70 is grounded as illustrated in FIG. 2. In the exemplary embodiment, a conductive property means that a volume resistivity is equal to or lower than $10^{10}$ Ωcm at 20° C.

In addition, in the exemplary embodiment, a distance between the transfer nip 90N and the chute 70 on the transporting path 48 and a distance between the transfer nip 90N and the fixing nip 60N on the transporting path 48 are shorter than the minimum length (for example, A4) of the recording medium P, which is used, in the transporting direction.

Figure 3:
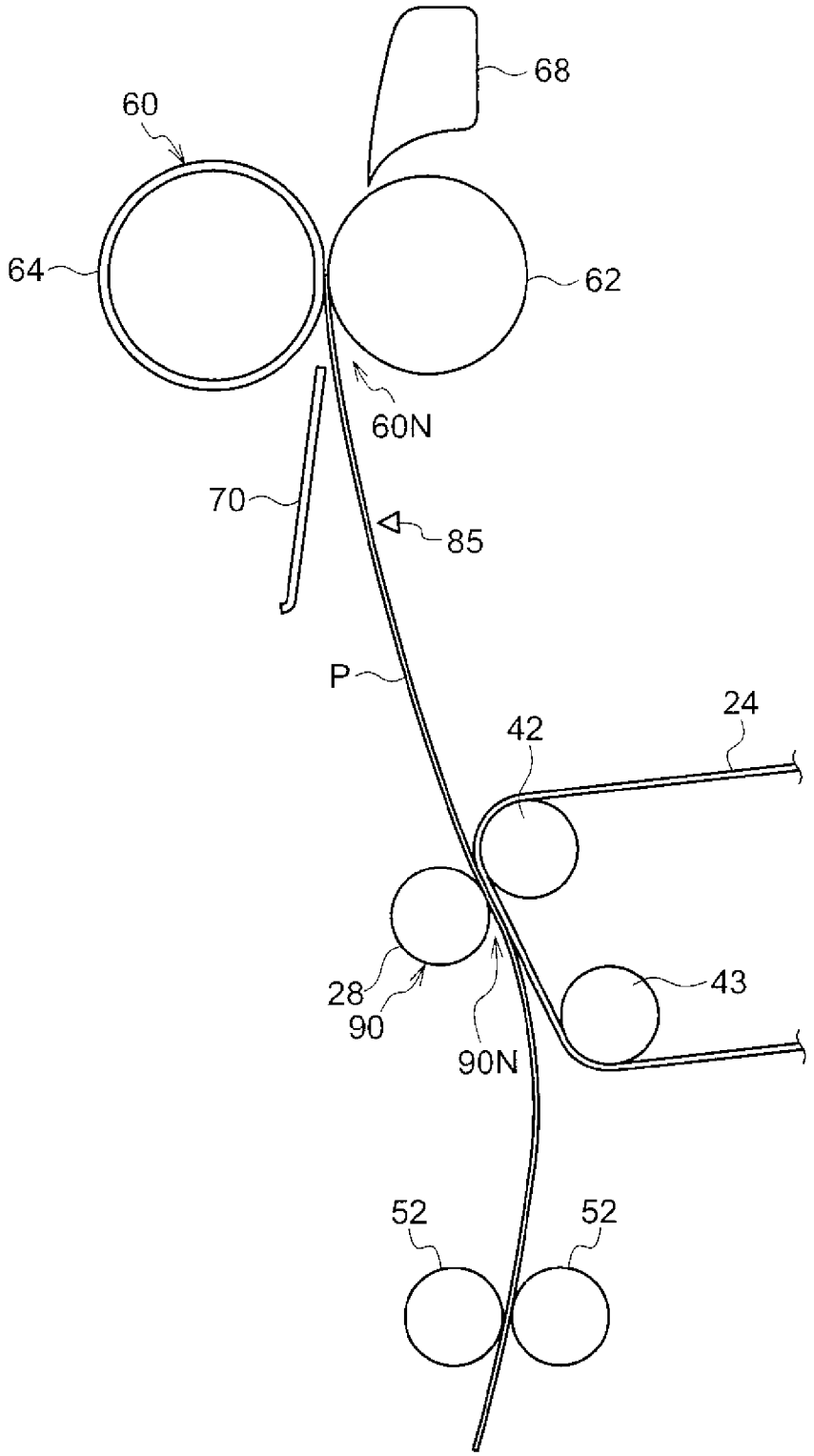
FIG. 3 is a schematic diagram illustrating a state where a leading end portion of a recording medium is nipped in a fixing nip of the image forming apparatus according to the exemplary embodiment.

Accordingly, as illustrated in FIG. 2, in a state where a leading end portion of the recording medium P is in contact with the chute 70, a portion on a trailing end side of the leading end portion of the recording medium P is nipped in the transfer nip 90N. As illustrated in FIG. 3, in a state where the leading end portion of the recording medium P is nipped in the fixing nip 60N, a portion which is on the trailing end side of the leading end portion of the recording medium P is nipped in the transfer nip 90N.

In the exemplary embodiment, a detecting sensor 85 that detects the leading end portion of the recording medium P is disposed between the fixing nip 60N (fixing device 60) and the transfer nip 90N (transferring unit 90) as illustrated in FIG. 1 and FIG. 2.

In addition, as illustrated in FIG. 1, a moisture content sensor 89 (an example of the detecting unit) that detects a moisture content of the recording medium P (hereinafter, referred to as medium moisture content) is provided in the image forming apparatus main body 11.

The moisture content sensor 89, for example, measures a resistance value of the recording medium P, and coverts the resistance value to a moisture content in order to obtain a medium moisture content. In addition, the moisture content sensor 89, for example, is disposed in the accommodating portion 12 as illustrated in FIG. 1. In other words, the moisture content sensor 89 detects the medium moisture content of the recording medium P before the recording medium P is transported to the chute 70. The medium moisture content is the mass of the moisture when the mass of the recording medium P is assumed to be 100. The moisture content sensor 89 is not limited to a case where the moisture content sensor 89 is disposed in the accommodating portion 12. Instead, the moisture content sensor 89 may be disposed on an upstream side of the chute 70 on the transporting path 48.

The detecting sensor 85 and the moisture content sensor 89 are connected to the controller 20. Accordingly, information of the leading end portion of the recording medium P detected by the detecting sensor 85 and information of the medium moisture content detected by the moisture content sensor 89 are transmitted to the controller 20.

From the transported speed of the recording medium P, the controller 20 estimates the time it takes for the recording medium P to reach the fixing nip 60N from a position at which the detecting sensor 85 detects the leading end portion of the recording medium P. The controller 20 estimates timing at which the leading end portion of the recording medium P is put into the fixing nip 60N from the information of the leading end portion of the recording medium P detected by the detecting sensor 85.

In the exemplary embodiment, the power supplying unit 92 is configured to be capable of selectively applying any one of a transfer voltage at a first voltage value and a transfer voltage at a second voltage value that is higher than the first voltage value to the winding roll 42. The controller 20 controls an operation of the power supplying unit 92 based on the acquired detection result of the medium moisture content.

Specifically, the controller 20 controls the transfer voltage that is applied by the power supplying unit 92 to the winding roll 42 in a case where the acquired medium moisture content is higher than a predetermined reference moisture content (an example of a second predetermined value).

The controller 20 controls the power supplying unit 92 such that the power supplying unit 92 applies the transfer voltage at the first voltage value to the winding roll 42 before the leading end portion of the recording medium P that is transported by the transferring unit 90 (the secondary transfer roll 28 and the intermediate transfer belt 24) is put into the fixing nip 60N. Once the leading end portion of the recording medium P that is transported by the transferring unit 90 (the secondary transfer roll 28 and the intermediate transfer belt 24) is put into the fixing nip 60N, the power supplying unit 92 applies the transfer voltage at the second voltage value that is higher than the first voltage value to the winding roll 42.

As described above, after the recording medium P transported by the transferring unit 90 is put into the fixing nip 60N, the power supplying unit 92 applies the transfer voltage that is higher than the transfer voltage applied before the recording medium P is put into the fixing nip 60N.

In addition, in the exemplary embodiment, the controller 20 controls the transfer voltage that is applied by the power supplying unit 92 to the winding roll 42 such that the transfer voltage is maintained to be constant in a case where the medium moisture content is equal to or lower than the predetermined reference moisture content.

Specifically, the controller 20 controls the power supplying unit 92 such that the power supplying unit 92 applies, to the winding roll 42, the transfer voltage at the predetermined voltage value before and after the leading end portion of the recording medium P that is transported by the transferring unit 90 (the secondary transfer roll 28 and the intermediate transfer belt 24) is put into the fixing nip 60N. As the predetermined voltage value, for example, the first voltage value, the second voltage value, and a voltage value other than the first voltage value and the second voltage value (for example, an intermediate value between the first voltage value and the second voltage value) are used.

The first voltage value and the second voltage value are set to values within a range in which the toner image does not get affected when the toner image is transferred onto the recording medium P. For example, the first voltage value is set to a minimum value or a value close to the minimum value within this range, and the second voltage value is set to a maximum value or a value close to the maximum value within this range. Specifically, the first voltage value is set, for example, to be in a range of 500 V to 1,000 V (exclusive of 1,000 V), and the second voltage value is set, for example, to be in a range of 1,000 V to 2,000 V.

The reference moisture content is set to a moisture content that allows an electric current to flow from the winding roll 42 to the chute 70 and the pressure belt 64 via the recording medium P when the transfer voltage at the first voltage value or the transfer voltage at the second voltage value is applied. Specifically, the reference moisture content is set, for example, to be in a range of 7.0% to 11.0%.

Effects of Exemplary Embodiment

Hereinafter, effects of the exemplary embodiment will be described in comparison with effects of a configuration in a first comparative example and a configuration in a second comparative example.

In the configuration according to the first comparative example and the configuration according to the second comparative example, a constant transfer voltage is applied to the winding roll 42, for example, regardless of a medium moisture content and a timing at which the leading end portion of the recording medium P is put into the fixing nip 60N. In the configuration according to the first comparative example, for example, the aforementioned second voltage value that is higher than the first voltage value is used as a voltage value of the constant transfer voltage. In the configuration according to the second comparative example, for example, the first voltage value is used as a voltage value of the constant transfer voltage.

As described above, according to the configuration of the first comparative example, the transfer voltage at the second voltage value that is higher than the first voltage value is applied to the winding roll 42 regardless of the timing at which the leading end portion of the recording medium P is put into the fixing nip 60N. Accordingly, in the configuration of the first comparative example, the transfer voltage at the second voltage value that is higher than the first voltage value is applied to the winding roll 42 even in a state where the leading end portion of the recording medium P is in contact with the chute 70 or the portion which is further on the trailing end side than the leading end portion of the recording medium P is nipped in the transfer nip 90N.

Figure 4:
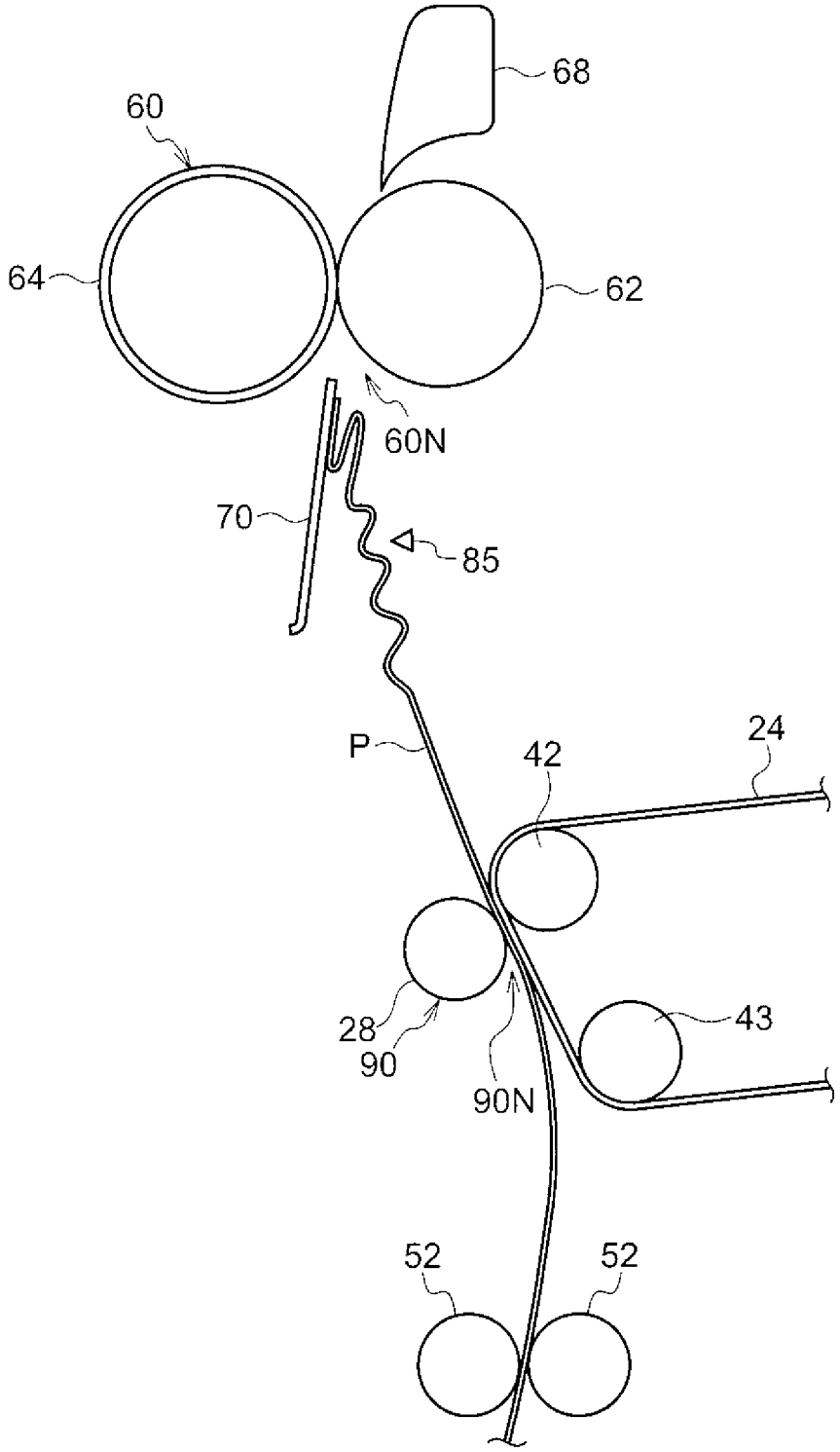
FIG. 4 is a schematic diagram illustrating a state where the recording medium is adhered to a chute to be jammed according to a comparative example.

Accordingly, in a case where the medium moisture content is high, the electric current is likely to flow from the winding roll 42 to the chute 70 via the recording medium P, compared to a case where the transfer voltage at the first voltage value is applied. Once the electric current flows to the chute 70, in some cases, the leading end portion of the recording medium P is adhered to the chute 70 by electrostatic force. Once the leading end portion of the recording medium P is adhered to the chute 70, in some cases, the recording medium P gets jammed as illustrated in FIG. 4.

In addition, according to the configuration of the second comparative example, the transfer voltage at the first voltage value is applied to the winding roll 42 regardless of the timing at which the leading end portion of the recording medium P is put into the fixing nip 60N. Accordingly, in the configuration of the second comparative example, the transfer voltage at the first voltage value is applied to the winding roll 42 even in a state where the leading end portion of the recording medium P is nipped in the fixing nip 60N and the portion on the trailing end side of the leading end portion of the recording medium P is nipped in the transfer nip 90N.

Figure 5:
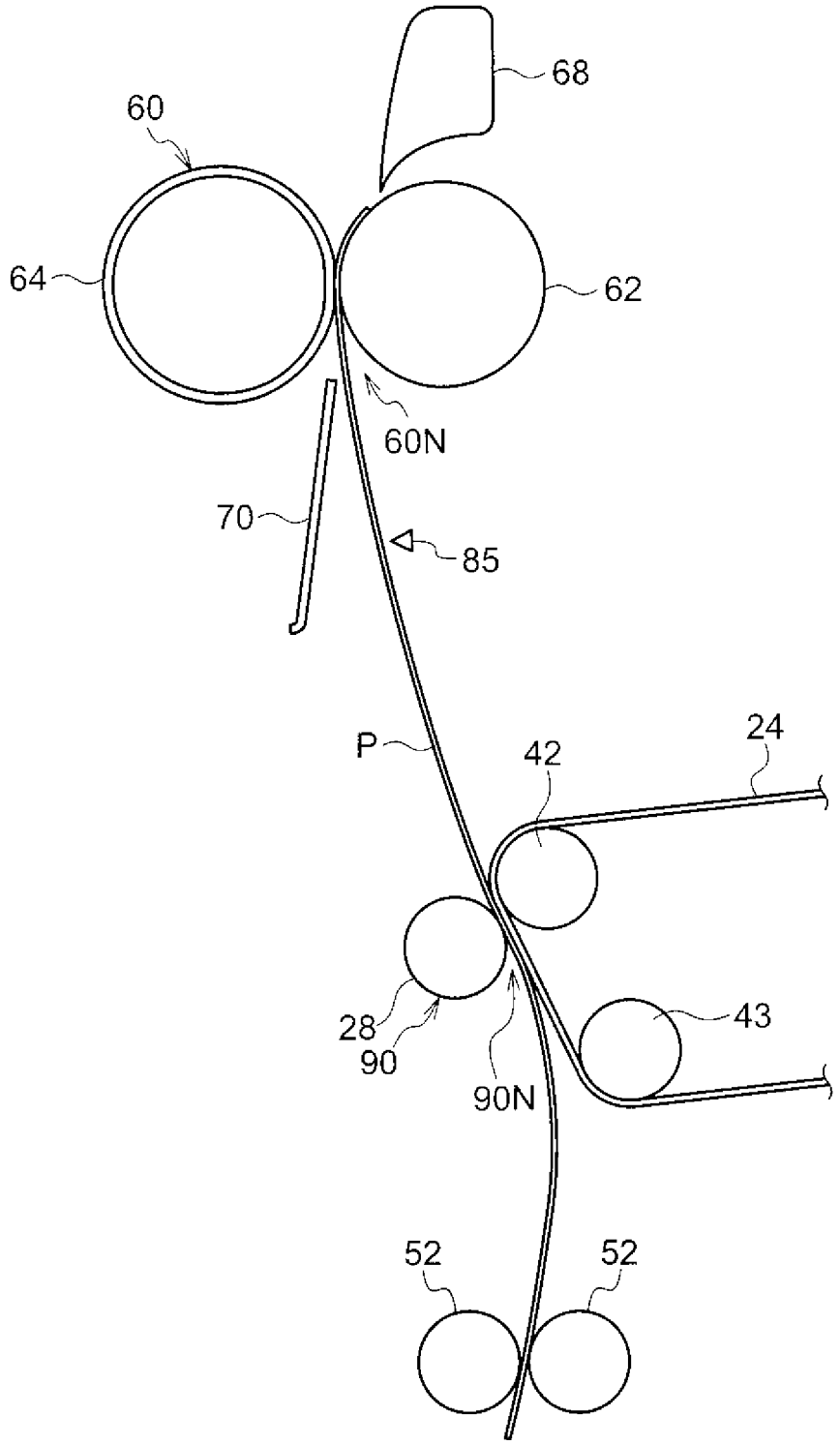
FIG. 5 is a schematic diagram illustrating a state where the recording medium is adhered to a fixing roll according to another comparative example.

Accordingly, even in a case where the medium moisture content is high, the electric current is unlikely to flow from the winding roll 42 to the pressure belt 64 via the recording medium P, compared to a case where the transfer voltage at the second voltage value is applied. For this reason, even though the electric current flows to the pressure belt 64, electrostatic force exerted on the recording medium P is weak or electrostatic force is not exerted on the recording medium P. As a result, in some cases, the leading end portion of the recording medium P is adhered to the fixing roll 62 by adhesion of toner on the toner image as illustrated in FIG. 5. Once the leading end portion of the recording medium P is adhered to the fixing roll 62, even the separation pawl 68 may not separate the recording medium P, and the recording medium P gets jammed in some cases.

Therefore, in the exemplary embodiment, the controller 20 controls the transfer voltage applied by the power supplying unit 92 to the winding roll 42 in a case where the medium moisture content is higher than the predetermined reference moisture content (an example of the second predetermined value).

The controller 20 controls the power supplying unit 92 such that the power supplying unit 92 applies the transfer voltage at the first voltage value to the winding roll 42 before the leading end portion of the recording medium P that is transported by the transferring unit 90 (the secondary transfer roll 28 and the intermediate transfer belt 24) is put into the fixing nip 60N.

Accordingly, the electric current is unlikely to flow from the winding roll 42 to the chute 70 via the recording medium P, compared to the first comparative example. The electrostatic force generated by the electric current being flowed to the chute 70 is not exerted on the recording medium P, and thereby the adhering of the leading end portion of the recording medium P onto the chute 70 is prevented. Accordingly, a recording medium P jam that occurs at the chute 70 is prevented, and the recording medium P is appropriately transported to the fixing nip 60N.

In the exemplary embodiment, once the leading end portion of the recording medium P that is transported by the transferring unit 90 (secondary transfer roll 28 and intermediate transfer belt 24) is put into the fixing nip 60N, the power supplying unit 92 applies the transfer voltage at the second voltage value that is higher than the first voltage value to the winding roll 42.

Figure 6:
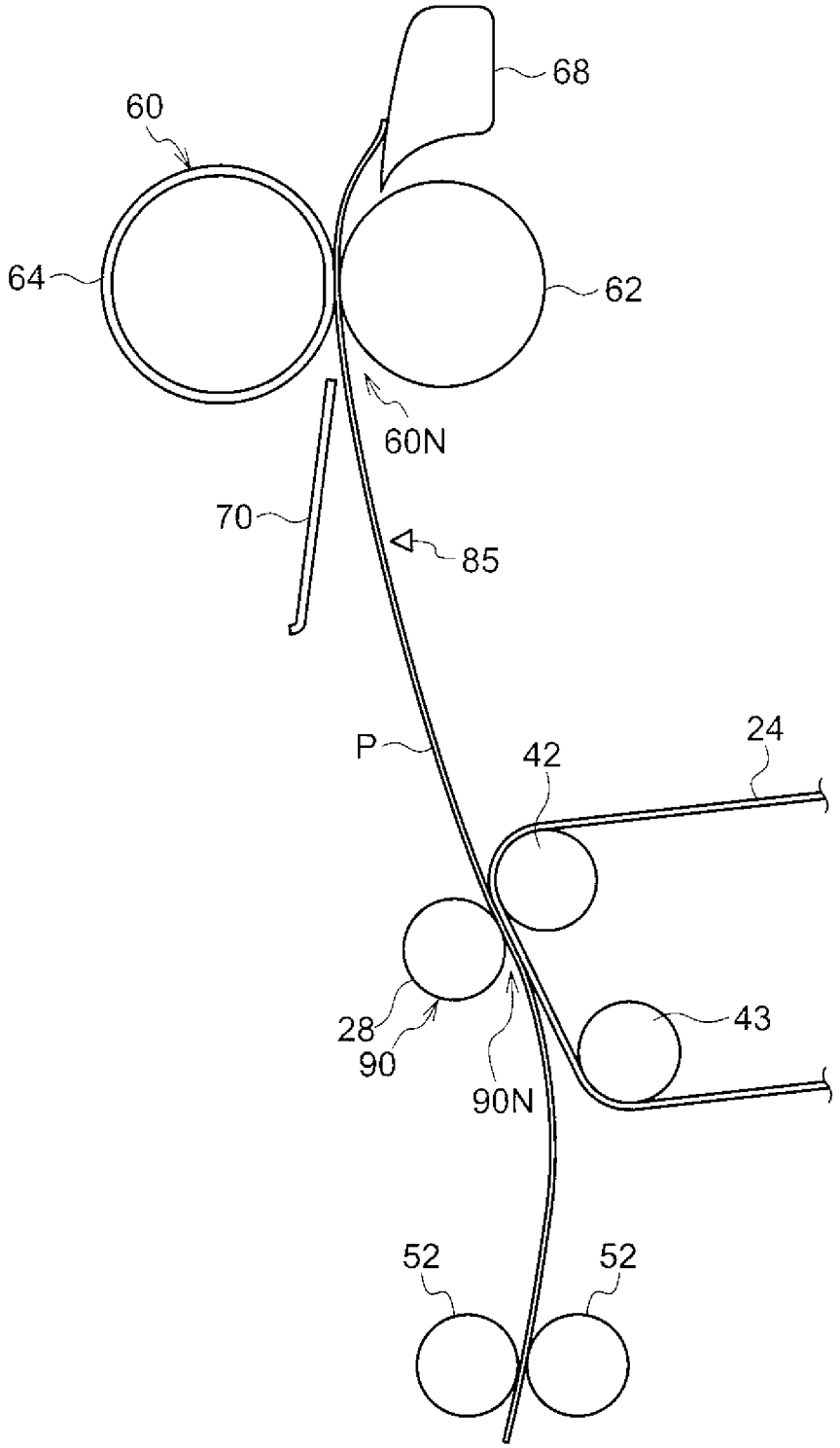
FIG. 6 is a schematic diagram illustrating a state where the recording medium is separated from the fixing roll of the image forming apparatus according to the exemplary embodiment.

Accordingly, the electric current is likely to flow from the winding roll 42 to the pressure belt 64 via the recording medium P, compared to the second comparative example. Once the electric current flows to the pressure belt 64, the leading end portion of the recording medium P is pulled by the electrostatic force toward the pressure belt 64 against the adhesion of the toner. Accordingly, the adhering of the leading end portion of the recording medium P onto the fixing roll 62 is prevented, and the recording medium P is appropriately separated by the separation pawl 68 as illustrated in FIG. 6. As a result, the recording medium P jam is prevented.

As described above, in the exemplary embodiment, after the leading end portion of the recording medium P is put into the fixing nip 60N, the power supplying unit 92 applies, to the winding roll 42, the transfer voltage that is higher than the transfer voltage applied before the recording medium P is put into the fixing nip 60N in a case where the medium moisture content is higher than the predetermined reference moisture content (an example of the second predetermined value).

As a result, compared to a configuration in which a control to change the magnitude of the transfer voltage is performed regardless of the medium moisture content, unnecessary control of the transfer voltage can be omitted under a condition where the adhering of the recording medium P onto the chute 70 and the fixing roll 62 is unlikely to occur.

In addition, in the exemplary embodiment, the controller 20 controls the transfer voltage that is applied by the power supplying unit 92 to the winding roll 42 such that the transfer voltage is maintained to be constant in a case where the medium moisture content is equal to or lower than the predetermined reference moisture content (an example of the second predetermined value).

Specifically, the controller 20 controls the power supplying unit 92 such that the power supplying unit 92 applies, to the winding roll 42, the transfer voltage at the predetermined voltage value before and after the leading end portion of the recording medium P that is transported by the transferring unit 90 (the secondary transfer roll 28 and the intermediate transfer belt 24) is put into the fixing nip 60N.

In this configuration, compared to the configuration in which the control to change the magnitude of the transfer voltage is performed, transfer nonuniformity of image caused by changing the magnitude of the transfer voltage is prevented even in a case where the medium moisture content is equal to or lower than the predetermined reference moisture content under the condition where the adhering of the recording medium P onto the chute 70 and the fixing roll 62 is unlikely to occur.

First Modification Example

In the exemplary embodiment, the operation of the power supplying unit 92 is controlled based on the detection result of the medium moisture content. Without being limited thereto, however, the operation of the power supplying unit 92 may be controlled, for example, based on the detection result obtained by detecting a humidity inside the image forming apparatus main body 11 (hereinafter, referred to as an in-device humidity).

In this configuration, a hygrometer 88 (an example of the detecting unit) that detects an in-device humidity is provided in the image forming apparatus main body 11. The hygrometer 88 is connected to the controller 20, and information of the in-device humidity detected by the hygrometer 88 is transmitted to the controller 20.

The controller 20 controls the transfer voltage applied by the power supplying unit 92 to the winding roll 42 in a case where the acquired in-device humidity is higher than a predetermined reference humidity (an example of a first predetermined value).

The controller 20 controls the power supplying unit 92 such that the power supplying unit 92 applies the transfer voltage at the first voltage value to the winding roll 42 before the leading end portion of the recording medium P that is transported by the transferring unit 90 (the secondary transfer roll 28 and the intermediate transfer belt 24) is put into the fixing nip 60N. When the leading end portion of the recording medium P that is transported by the transferring unit 90 (the secondary transfer roll 28 and the intermediate transfer belt 24) is put into the fixing nip 60N, the power supplying unit 92 applies the transfer voltage at the second voltage value that is higher than the first voltage value to the winding roll 42.

In addition, in the exemplary embodiment, the controller 20 controls the transfer voltage that is applied by the power supplying unit 92 to the winding roll 42 such that the transfer voltage is maintained to be constant in a case where the in-device humidity is equal to or lower than the predetermined reference humidity.

Specifically, the controller 20 controls the power supplying unit 92 such that the power supplying unit 92 applies, to the winding roll 42, the transfer voltage at the predetermined voltage value before and after the leading end portion of the recording medium P that is transported by the transferring unit 90 (the secondary transfer roll 28 and the intermediate transfer belt 24) is put into the fixing nip 60N. As the predetermined voltage value, for example, the first voltage value, the second voltage value, and a voltage value other than the first voltage value and the second voltage value (for example, an intermediate value between the first voltage value and the second voltage value) are used.

The reference humidity is set to a humidity at which the recording medium P is assumed to have a moisture content that allows the electric current to flow from the winding roll 42 to the chute 70 and the pressure belt 64 via the recording medium P when the transfer voltage at the first voltage value or the transfer voltage at the second voltage value is applied. Specifically, the reference humidity is set, for example, to be in a range of 70% to 85%.

OTHER MODIFICATION EXAMPLES

In the exemplary embodiment and the first modification example described above, the operation of the power supplying unit 92 is controlled based on the detection results of the medium moisture content and the in-device humidity. Without being limited thereto, however, the power supplying unit 92 may perform a control to change the magnitude of the transfer voltage applied to the winding roll 42 regardless of a medium moisture content and an in-device humidity.

In addition, in the exemplary embodiment, the fixing roll 62 is used as an example of the fixing member. Without being limited thereto, however, a fixing belt, for example, may be used as an example of the fixing member.

In addition, in the exemplary embodiment, the pressure belt 64 is used as an example of the conductive member. Without being limited thereto, however, a pressure roll, for example, may be used as an example of the conductive member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transferring unit that transports a recording medium while transferring an image onto the recording medium by a transfer voltage being applied thereto;

a fixing member that fixes the transferred image onto the recording medium;

a conductive member that forms a nip portion in which the recording medium is nipped between the fixing member and the conductive member and that has a conductive property;

a guiding unit that is disposed between the transferring unit and the nip portion, that guides a leading end of the recording medium which is being transported by the transferring unit to the nip portion, and that has a conductive property; and an applying unit that applies, to the transferring unit, a transfer voltage which is higher than that applied before the recording medium is put into the nip portion, after the recording medium transported by the transferring unit is put into the nip portion.

2. The image forming apparatus according to claim 1, wherein the applying unit applies, to the transferring unit, the transfer voltage that is higher than the transfer voltage applied before the recording medium is put into the nip portion, after the recording medium transported by the transferring unit is put into the nip portion in a case where a detecting unit provided in an apparatus main body of the image forming apparatus detects a humidity that is higher than a first predetermined value or in a case where the detecting unit detects a moisture content of the recording medium that is higher than a second predetermined value.

3. The image forming apparatus according to claim 2, wherein the applying unit applies, to the transferring unit, the transfer voltage of a same magnitude before and after the recording medium transported by the transferring unit is put into the nip portion in a case where the detecting unit provided in the apparatus main body of the image forming apparatus detects the humidity which is equal to or lower than the first predetermined value or in a case where the detecting unit detects the moisture content of the recording medium that is equal to or lower than the second predetermined value.

* * * * *